United States Patent [19]

Armstrong et al.

[11] Patent Number: 4,825,502

[45] Date of Patent: May 2, 1989

[54] DEVICE FOR VISUAL INSPECTION OF FLUID FLOW

[75] Inventors: William H. Armstrong, Troy; Peter E. Linder, Southfield; Gary Kasper; Dean R. Rohn, both of Cadillac, all of Mich.

[73] Assignee: Rexair, Inc., Troy, Mich.

[21] Appl. No.: 70,225

[22] Filed: Jul. 6, 1987

[51] Int. Cl.[4] ..... A47L 9/10

[52] U.S. Cl. ..... 15/339; 15/350; 55/422

[58] Field of Search ..... 15/339, 347, 350; 55/422, 493, 495, 510

[56] References Cited

U.S. PATENT DOCUMENTS

| | | | |
|---|---|---|---|
| 944,779 | 12/1909 | Fogarty . | |
| 954,164 | 4/1910 | Broekema | 15/350 |
| 1,011,989 | 12/1911 | Mohr . | |
| 1,130,114 | 3/1915 | Small . | |
| 1,233,928 | 7/1917 | Small . | |
| 1,929,025 | 10/1933 | Leathers . | |
| 2,112,304 | 3/1938 | Rhed | 15/347 |
| 2,269,483 | 1/1942 | Replogle | 15/339 |
| 2,349,832 | 5/1944 | Replogle | 15/339 |
| 2,351,068 | 6/1944 | Replogle | 15/339 |
| 2,373,915 | 4/1945 | Replogle | 15/339 |
| 2,613,454 | 10/1952 | White | 15/350 |
| 2,910,717 | 11/1959 | Raymond . | |
| 3,063,077 | 11/1962 | Pansini . | |
| 3,267,650 | 8/1966 | Lundin . | |
| 3,277,512 | 10/1966 | Waters | 15/339 |
| 3,383,839 | 5/1968 | Hintermaier . | |
| 3,942,963 | 3/1976 | Tevis . | |
| 4,016,002 | 4/1977 | Vallak . | |
| 4,028,248 | 6/1977 | Murauskas | 55/493 |
| 4,317,664 | 3/1982 | Ciummo . | |
| 4,591,369 | 5/1986 | Stewart | 15/352 |
| 4,671,810 | 6/1987 | Dietzsch | 55/422 |

FOREIGN PATENT DOCUMENTS 1443494 7/1976 United Kingdom .

*Primary Examiner*—Harvey C. Hornsby
*Assistant Examiner*—Corinne M. Reinckens
*Attorney, Agent, or Firm*—Harness, Dickey & Pierce

[57] ABSTRACT

A device for allowing inspection of foreign matter in a stream of fluid flow in a conduit includes a filter disposed transversely in the fluid flow for filtering and collecting foreign matter from the fluid flow passing therethrough. A support frame supports the filter and allows connection to the conduit. A filter retainer is connected to the support frame for retaining the filter therebetween and has a first position disposed transversely in the fluid flow. A first pivotal member interconnects the filter retainer and the support frame for allowing pivotal movement of the filter retainer in a direction substantially perpendicular to the fluid flow from the first position to a second position outside the fluid flow to allow the filter to be removed and inspected.

21 Claims, 3 Drawing Sheets

DEVICE FOR VISUAL INSPECTION OF FLUID FLOW

TECHNICAL FIELD

The subject invention relates a device for allowing inspection of foreign matter in a stream of fluid flow in a conduit, and particularly, a transparent device containing a filter to be used with a vacuum cleaner.

BACKGROUND ART

A filter structure designed to be inserted in a suction air conduit and adapted to be connected to a suitable vacuum dusting tool has been used in the past. An example of such a device is disclosed in U.S. Pat. No. 2,613,254, issued Oct. 14, 1952, in the name of White. This patent discloses a housing adapted to be connected to the dusting tool hose of a vacuum cleaner. The housing includes a cover pivotally connected to the housing and having a perforated plate inclined within the housing against which a filter sheet rests. The cover may include a transparent insert so that the accumulation of dirt upon the filter may be visualized as the cleaning operation progresses. After a short period of cleaning operation, the vacuum cleaner is shut off and the cover is moved to the open position to allow removal of the filter sheet so that a prospective purchaser may have visual evidence of the dirt which was removed by the dusting tool.

The problem with such devices is that the vacuum cleaner must be turned off in order to remove and insert the filter element. Also, the transparent section is not large enough to allow adequate visual inspection of foreign matter collected on the filter.

STATEMENT OF THE INVENTION AND ADVANTAGES

A device for allowing inspection of foreign matter in a stream of fluid flow in a conduit includes a filter disposed transversely in the fluid flow for filtering and collecting foreign matter from the fluid flow passing therethrough. A support frame supports the filter and allows connection to the conduit. A filter retainer is connected to the support frame for retaining the filter therebetween and has a first position disposed transversely in the fluid flow, and a second position outside the fluid flow to allow the filter to be removed and inspected.

Accordingly, the subject invention allows the filter to be moved from a first to a second position outside the fluid flow to allow removal and insertion of the filter without turning off the vacuum cleaner. Also, the filter retainer has one portion completely transparent to allow visual inspection of the entire filter element.

Other advantages of the present invention will be readily appreciated as the same becomes better understood by reference to the following detailed description when considered in connection with the accompanying drawings.

FIGURES IN THE DRAWINGS

DETAILED DESCRIPTION OF THE DRAWINGS

Figure 1:
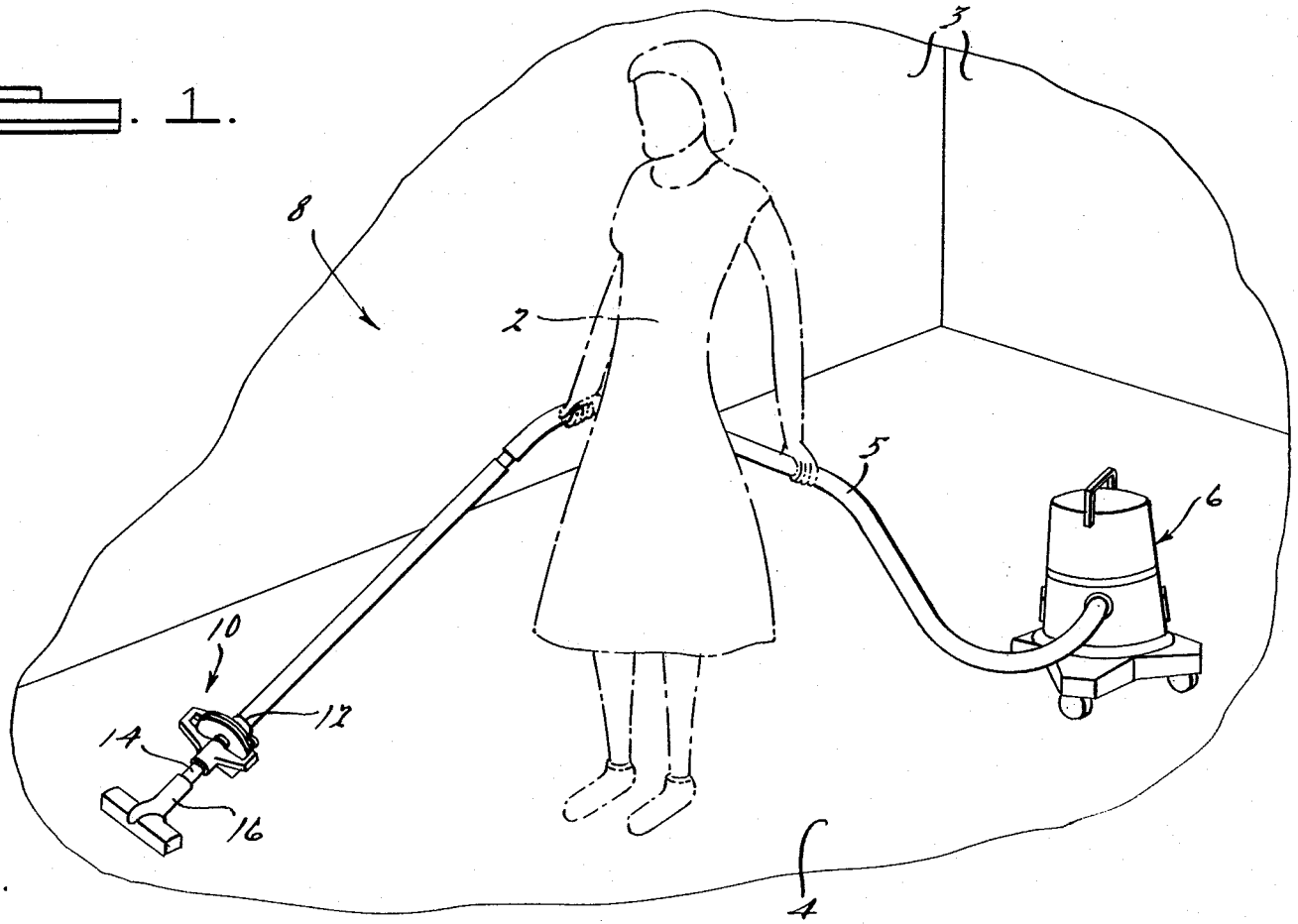
FIG. 1 is a perspective view of an operator using the subject invention connected to a vacuum cleaner.

As illustrated in FIG. 1, an operator 2 is standing in a room having walls 3 and a floor 4. A dusting or vacuum hose 5 is connected to a vacuum cleaner 6 which is movable across the floor 4. The dusting hose 5 has its other end connected to a device 10 which allows visual inspection of air flow from the floor 4 to the vacuum cleaner 6. The dusting hose 5 has one end disposed in a first conduit 12 of the device 10. A dusting attachment 16 is connected to a second conduit 14 of the device 10. Dirt and foreign matter travels in the airflow from the floor 4, though the dusting attachment 16, device 10 and dusting hose 5, and to the vacuum cleaner 6.

Figure 2:
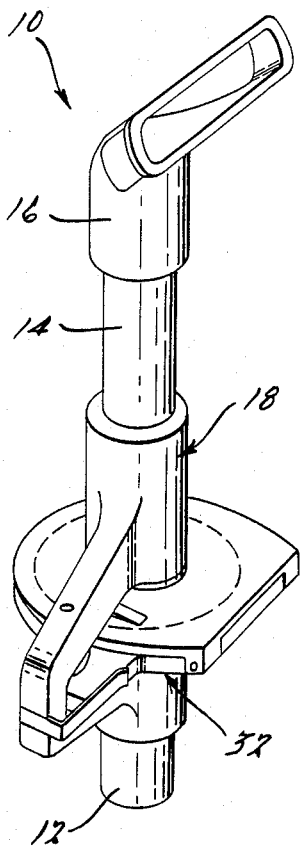
FIG. 2 is a perspective view of the device in which the filter retainer is in a closed first position.
Figure 3:
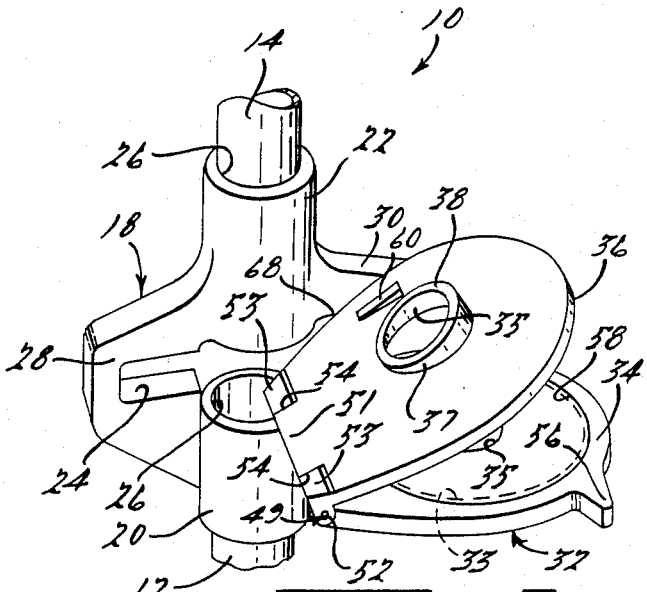
FIG. 3 is a perspective view of the device showing the filter retainer in a second position with the lid member open in a third position.

As illustrated in FIGS. 2 and 3, the device 10 includes a support frame, generally indicated at 18, for connection to the first conduit 12. The support frame 18 includes a first end 20 being tubular in shape and disposed about the conduit 12, and a second end 22 being tubular in shape and disposed about the second conduit 14. The first end 20 is axially spaced from the second end 22. The support frame 18 includes side flanges 28 and 30 interconnecting the first end 20 and second end 22. The side flanges 28, 30 form a first aperture 24 communicating transversely through the support frame 18. The support frame 18 also includes a second aperture 26 communicating from the first end 20 to the second end 22 in a direction parallel to the fluid flow and disposed in series with the fluid flow to allow the fluid flow to enter and exit the support frame 18 in the original direction of the fluid flow.

The device 10 also includes a filter retainer, generally indicated at 32, connected to the support frame 18 for retaining a filter 33 therebetween and having a first position disposed transversely in the fluid flow. The filter 33 is disposed transversely in the fluid flow for filtering and collecting foreign matter from the fluid flow passing therethrough. The filter 33 comprises a porous member being configured as a thin plate and made of a thin paper material. The filter retainer 32 comprises a base member 34 and a lid member 36 connected to the base member 34. The filter 33 is disposed between the base member 34 and lid member 36. The filter retainer 32 also includes a fluid aperture 35 communicating through the filter retainer 32 and in series with the second aperture 26 of the support frame 18 to allow the fluid flow to pass. A boss 37 is formed about the fluid aperture 37 on both the base member 34 and lid member 36. The top surface 38 of the boss 37 is also inclined.

The device 10 further includes a first pivotal connection 39 interconnecting the filter retainer 32 and the support frame 18 for allowing pivotal movement of the filter retainer 32 in a direction substantially perpendicular to the fluid flow from a first position disposed transversely in the fluid flow to a second position outside the fluid flow to allow the filter 33 to be removed and inspected. The base member 34 includes a flange 40 connected to one side. The flange 40 is also pivotally connected to the support frame 18 within the first aperture 26. The first pivotal connection 39 comprises a third aperture 42 formed in the flange 40, and a first rod 46 is disposed in the third aperture 42 and connected to the support frame 18. The first rod 46 is disposed in the first aperture 24.

Figure 4:
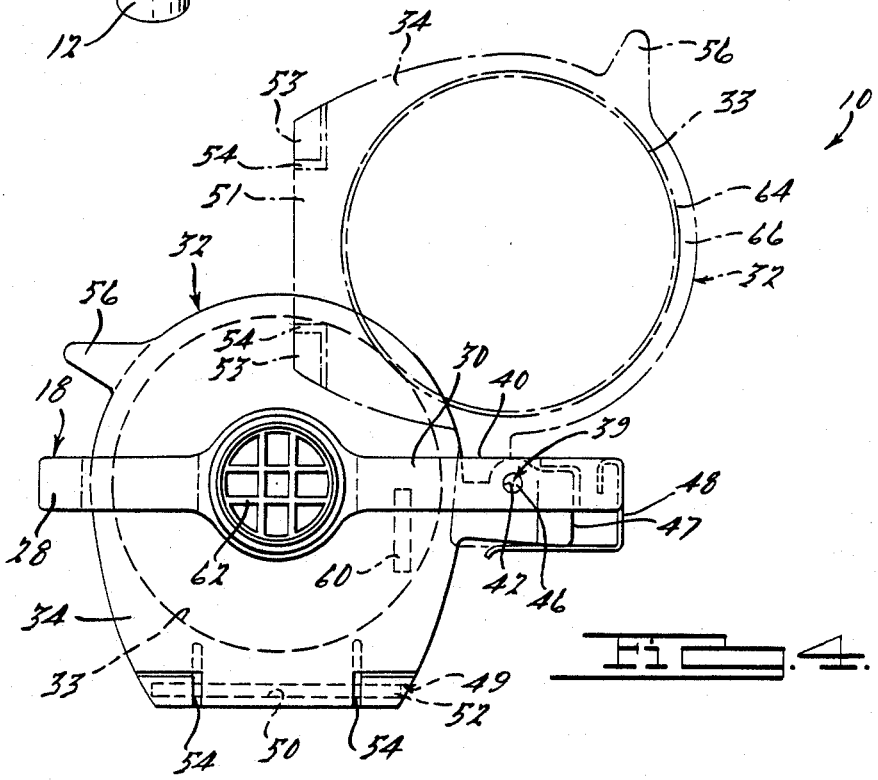
FIG. 4 is a plan view of the device showing the filter retainer in a first position and a second position as indicated by the phantom lines.

As shown in FIG. 4, the flange 40 includes a camming portion 47 at one end thereof. A leaf spring 48 is connected to the side flange 30 and cooperates with the camming portion 47 to bias the filter retainer 32 in either the first or second position.

As shown in FIGS. 3 and 4, the device 10 further includes a second pivotal connection 49 interconnecting lid member 36 and base member 34 to allow pivotal movement of the lid member 36 while the filter retainer 32 is in the second position to allow the filter 33 to be removed and replaced. The second pivotal connection 49 comprises an aperture 50 communicating through a projection 51 of the base member 34 and a pair of flanges 53 on lid member 36 at each end of the projection 51. A rod 52 is disposed in the aperture 50 to allow pivotal movement of the lid member 36 in relation to the base member 34. A coil spring 54 is disposed about the rod 52 between the lid member 36 and base member 34 to bias the lid member 36 to an open position when the filter retainer 32 is in its second position.

The base member 34 includes a handle 56 connected to one side thereof to manually move the filter retainer 32 to and from its first and second positions. The base member 34 also includes a recess 58 therein to aid in retaining the filter 33. Hence, the filter 33 will be disposed between the lid member 36 and the base member 34 in the recess 58. The lid member 36 may also include a member 60 to manually move the lid member 36 to and from its open and closed positions. The lid member 36 is also transparent to allow visual inspection of foreign matter collected on the filter 33. The base member 34 includes a screen 62 disposed in the fluid aperture 35 of the boss 37 to allow fluid flow, but to prevent the paper filter 33 itself passing through the fluid aperture 35. The lid member 36 includes a recess 64 to allow a gasket or O-ring 66 to be disposed therein to act as a seal to prevent the fluid flow from escaping from the filter retainer 32 when it is disposed in its first position.

Figure 5:
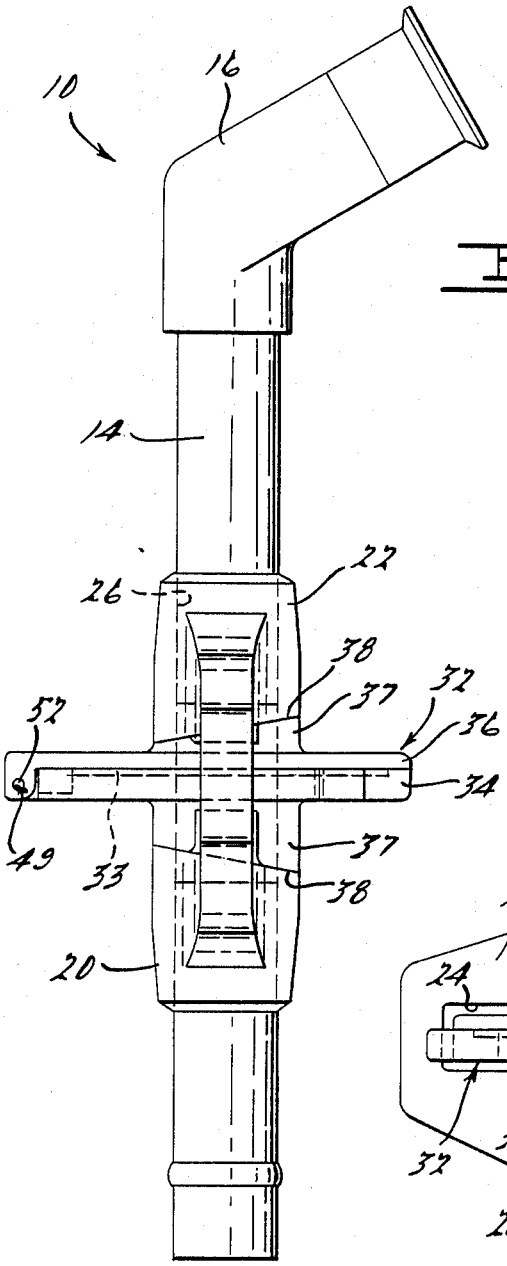
FIG. 5 is a side elevational view of the device.
Figure 6:
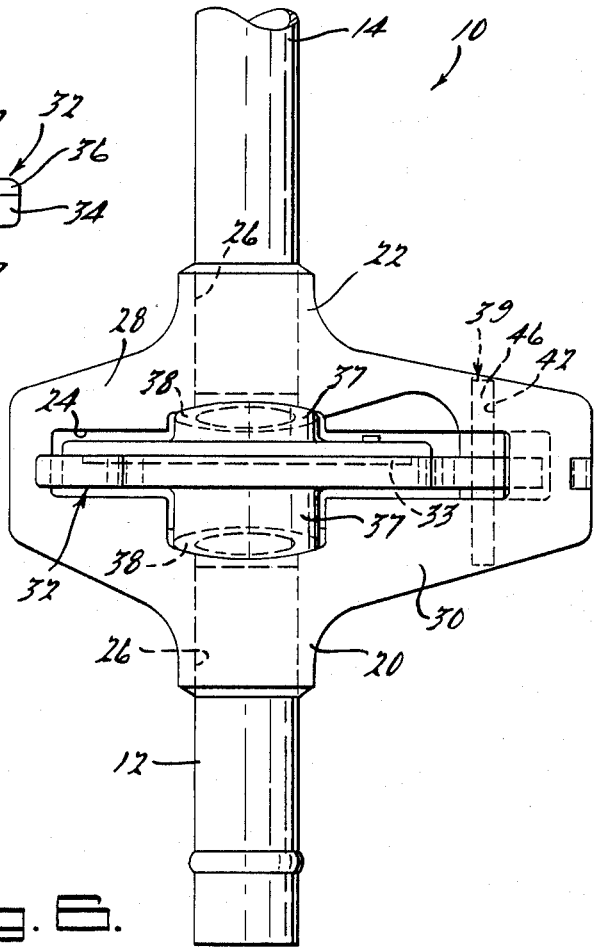
FIG. 6 is a front elevational view of the device.

As illustrated in FIGS. 5 and 6, the side flange 30 of the support frame 18 also includes an inclined recess portion 68 to bias or guide the lid member 36 from its open position to its closed position as the filter retainer 32 is moved from its second to its first position. The lid member 36 engages the recess portion 68 and is forced downward to its closed position.

In operation, a filter 33 is placed in the recess 58 of the base member 34. The lid member 36 is moved from its open position to its closed position upon the base member 34. The lid member 36 and base member 34 are then pivotally moved from its second position to its first position disposed transversely in the fluid flow. The members 34, 36 will then be disposed in the second aperture 26 of the support frame 18. As fluid flows from the first conduit 12 through the device 10 to the second conduit 14, foreign matter will collect upon the filter 33. The transparency of the lid member 36 will allow visual inspection of foreign matter upon the filter 33. As the vacuum cleaner 6 is running or fluid is flowing from the first conduit 12 to the second conduit 14, the members 34 and 36 may be moved from the first position to the second position outside the fluid flow. The lid member 36 is then pivotally moved to an open position to allow removal and replacment of the filter 33 while the fluid flow is flowing from the first conduit 12 to the second conduit 14. Hence, the vacuum cleaner 6 is not required to be stopped or shut off to remove and replace the filter 23.

The subject invention has been described in an illustrative manner. It is to be understood that the terminology which has been used is intended to be in the nature of words of description rather than of limitation.

Obviously, many modifications and variations of the subject invention are possible in light of the above teachings. Therefore, the subject invention may be practiced otherwise than as specifically described.

What is claimed is:

1. A device for allowing visual inspection of foreign matter in a stream of fluid flow through a hose connected to a vacuum cleaner, said device comprising:

means for filtering and collecting foreign matter from the fluid flow passing therethrough said filter and collection means being disposed transversely in said hose;

means for connecting said filter and connection means to one end of the hose, the other end of the hose being connected to the vacuum cleaner;

means for retaining said filter and collection means, said retaining means being coupled to and moving from a first position to a second position with respect to said connecting means, said retaining means comprised of a base member, a lid member, and means interconnecting said lid member and said base member for allowing pivotal movement of said lid member between an open and closed position with respect to said base member to allow said filter and collection means to be removed and replaced between said base member and said lid member, wherein in said first position, said lid member is in the closed position and said lid member and said base member are dispoed transversely in the fluid flow;

means for allowing pivotal movement of said lid member and said base member with respect to said connecting means in a direction substantially perpendicular to the fluid flow between said first position and said second position outside the fluid flow, wherein said lid member is in the open position, such that said lid member and said base member exhibits unconstrained movement between said first position and said second position.

2. A device as set forth in claim 1 characterized by said lid member being transparent to allow visual inspection of foreign matter collected on said filter and collection means.

3. A device as set forth in claim 1 characterized by said connection means including means forming a first aperture communicating transversely through said connection means to allow said filter retainer means to be disposed in said aperture when said filter retainer means is in said first position.

4. A device as set forth in claim 3 further characterized by said connection means including a second aperture communicating therethrough in a direction parallel to the fluid flow and disposed in series with the fluid flow to allow the fluid flow to enter and exit said connection means.

5. A device as set forth in claim 4 further characterized by said base member including a flange connected to one side thereof and pivotally connected to said connection means.

6. A device as set forth in claim 5 further characterized by said first pivotal means comprising a third aperture in said flange and a rod disposed in said third aperture and connected to said connection means.

7. A device as set forth in claim 4 characterized by said filter retainer means including means for forming an aperture communicating through said filter retainer means and in series with said second aperture of said connection means to allow the fluid flow to pass therethrough.

8. A device set forth in claim 7 further characterized by said base member including a flange connected to one side thereof and pivotally connected to said connection means within said first aperture.

9. A device as set forth in claim 8 further characterized by said first pivotal means comprising a third aperture in said flange and a rod disposed in said third aperture and connected to said connection means.

10. A device as set forth in claim 9 further characterized by said second pivotal means comprising a fourth aperture in said base member, a fifth aperture in said transparent member, and a rod disposed in said fourth and fifth aperture.

11. A device as set forth in claim 10 further characterized by said base member including a handle connected to one side thereof to manually move said filter retainer means to and from said first position and said second position.

12. A device as set forth in claim 11 further characterized by said base member including a recess therein to retain said filter and collection means.

13. A device as set forth in claim 12 further characterized by said transparent member including a handle to manually move said transparent member between said open and said closed positions.

14. A device as set forth in claim 13 further characterized by said filter and collection means comprising a porous member being configured as a thin plate.

15. A device as set forth in claim 14 further characterized by said porous member being made of a paper material.

16. A device as set forth in claim 12 including a means for biasing said filter retainer means in either one of said first and second position.

17. A device as set forth in claim 12 including a means for biasing said lid member to said open position.

18. A device as set forth in claim 12 including means for guiding said lid member from said open position to said closed position as said filter retainer means is moved from said second to said first position.

19. A device as set forth in claim 12 including means for preventing said filter and collection means from exiting said filter retainer means through said second aperture.

20. A device as set forth in claim 12 including means for preventing fluid flow from exiting between said base member and said lid member when said filter retainer means is in said first position.

21. A device for allowing visual inspection of foreign matter in a stream of fluid flow in a conduit, said device comprising:

means disposed transversely in the fluid flow for filtering and collecting foreign matter from the fluid flow passing therethrough;

means for connecting said filter and collection means to a conduit;

means connected to said connection means for retaining said filter and collection means therebetween and having a first position disposed transversely in the fluid flow;

means interconnecting said filter retainer means and said support means for allowing unobstructed pivotal movement of said filter retainer means in a direction substantially perpendicular to the fluid flow from said first position to a second position outside the fluid flow;

said filter retainer means comprising a base member and a lid member connected to said base member and being transparent to allow visual inspection of foreign matter collected on said filter and collection means, said filter and collection means being disposed between said base member and said lid member;

means interconnecting said lid member and said base member for allowing pivotal movement of said lid member substantially parallel to the fluid flow between an open and closed position with respect to said base member to allow said filter and collection means to be removed and replaced;

said filter and collection means comprising a porous member being configured as a thin plate and made of a thin paper material;

said filter retainer means including means forming an aperture communicating through said filter retainer means to allow the fluid flow to pass therethrough;

said connection means including means forming a first aperture communicating transversely through said connection means to allow said filter retainer means to be disposed in said aperture when said filter retainer means is in said first position;

said base member including a handle connected to one side thereof to manually move said filter retainer means to and from said first position and said second position;

said base member including a recess therein to contain said filter and collection means;

said lid member including a handle to manually move said lid member between said open and said closed positions;

said connection means including a second aperture communicating therethrough in a direction parallel to the fluid flow and disposed in series with the fluid flow to allow the fluid flow to enter and exit said support means in the original direction of the fluid flow;

said base member including a flange connected to one side thereof and pivotally connected to said connection means within said first aperture;

said first pivotal means comprising a third aperture in said flange and a rod disposed in said aperture and connected to said connection means;

said second pivotal means comprising a fourth aperture in said base member, and a fifth aperture in said transparent member, and a rod disposed in said aperture;

a first spring connected to said support means for biasing said filter retainer means in either one of said first and second positions;

a second strip interconnecting said lid member and said base member for biasing said lid member to said open position;

a guide portion on said connection means for guiding said lid member from said open position to said closed position as said filter retainer means is moved from said second to said first position;

a screen disposed in said fluid aperture for preventing said filter and collection means from exiting said retaining means through said second aperture; and a gasket disposed between said lid and base members for preventing fluid flow from exiting therebetween when said filter retainer means is in said first position.

* * * * *